US011807505B2

(12) United States Patent
Peterson et al.

(10) Patent No.: US 11,807,505 B2
(45) Date of Patent: Nov. 7, 2023

(54) SAFETY CATCH SYSTEM

(71) Applicant: Robert Bosch GmbH, Stuttgart (DE)

(72) Inventors: Corday Peterson, Fountain, MN (US); Corey Schlichter, Faribault, MN (US);
(Continued)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 36 days.

(21) Appl. No.: 18/059,225

(22) Filed: Nov. 28, 2022

(65) Prior Publication Data

US 2023/0093171 A1 Mar. 23, 2023

Related U.S. Application Data

(62) Division of application No. 16/818,245, filed on Mar. 13, 2020, now Pat. No. 11,584,627.

(51) Int. Cl.
*B66F 5/00* (2006.01)
*B66F 17/00* (2006.01)
(Continued)

(52) U.S. Cl.
CPC ..... *B66F 17/006* (2013.01); *B66F 7/08* (2013.01); *B66F 7/0625* (2013.01);
(Continued)

(58) Field of Classification Search
CPC ..... B66F 17/005; B66F 7/08; B66F 7/0625;
(Continued)

(56) References Cited

U.S. PATENT DOCUMENTS 4,815,712 A 3/1989 Kawada
4,909,357 A 3/1990 Kawada
(Continued)

FOREIGN PATENT DOCUMENTS

CN 203173775 U 9/2013
CN 105776061 A 7/2016

OTHER PUBLICATIONS

"3,000 lb. Capacity EV Battery and Powertrain Lift Table", Ford Rotunda Service Solutions, https://rotunda.service-solutions.com/en-US/Pages/ItemDetail.aspx?SKU=014-3KLIFTTABLE, available at least as early as Sep. 2, 2020 (2 pages).
(Continued)

*Primary Examiner* — Lee D Wilson
(74) *Attorney, Agent, or Firm* — Maginot, Moore & Beck LLP

(57) ABSTRACT

A safety latch system includes a mount, a pawl member, a ratchet member, and a release assembly. The mount is mountable on a housing of a piston. The pawl member is coupled to the mount. The pawl member includes a pawl. The ratchet member has a first sidewall that includes a first connecting portion that is connectable to an end portion of a piston rod of the piston. The first sidewall includes a teeth portion, which is configured to engage with the pawl. The release assembly is configured to provide an engaged state between the pawl member and the ratchet member. The release assembly is also configured to provide a disengaged state between the pawl member and the ratchet member. When in the engaged state, the pawl member is engaged with the ratchet member such that the safety latch system is configured to provide (i) an unlocked state in which the ratchet member is movable relative to the pawl member as the piston rod advances outward from the housing and (ii) a locked state in which the pawl member is configured to lock into a depression between adjacent teeth of the ratchet mem-
(Continued)

ber to stop the piston rod from moving towards the housing. When in the disengaged state, the pawl member is disengaged from the ratchet member to permit the piston rod to advance outward from the housing and permit the piston rod to retract towards the housing.

7 Claims, 9 Drawing Sheets

(72) Inventors: Stanley Norland, Blooming Prarie, MN (US)

(51) Int. Cl.
*B66F 7/08* (2006.01)
*B66F 7/28* (2006.01)
*B66F 7/06* (2006.01)

(52) U.S. Cl.
CPC ..... *B66F 7/0666* (2013.01); *B66F 7/28* (2013.01); *B66F 2700/02* (2013.01)

(58) Field of Classification Search
CPC ..... B66F 7/0666; B66F 7/00; B66F 7/065

See application file for complete search history.

(56) References Cited

U.S. PATENT DOCUMENTS

| | | | | |
|---|---|---|---|---|
| 8,770,549 | B2* | 7/2014 | Deuring et al. | B66F 7/065 254/122 |
| 10,544,019 | B2 | 1/2020 | Kochie et al. | |
| 2003/0218157 | A1 | 11/2003 | Arzouman | |
| 2007/0170407 | A1* | 7/2007 | Ruan | B66F 1/04 254/108 |
| 2008/0173852 | A1* | 7/2008 | Woodbury et al. | B66F 5/04 254/8 B |
| 2021/0284512 | A1 | 9/2021 | Peterson et al. | |

OTHER PUBLICATIONS

"GE-52200 Propulsion System Lift", Bosch Automotive Service Solutions, Promotion # GM16-352, 2016 (2 pages).
"GE-52200 Propulsion System Lift", GM Special Service Tools, https://gmtoolsandequipment.com/en-US/Pages/ItemDetail.aspx?SKU=GE-52200, available at least as early as Sep. 2, 2020, (1 page).
"PowerTrain Lift (SKU 5295)," OTC Tools, https://www.otctools.com/products/powertrain-lift, available at least as early as Sep. 2, 2020 (5 pages).
International Search Report corresponding to PCT Application No. PCT/EP2021/053605, mailed May 14, 2021 (5 pages).

* cited by examiner

SAFETY CATCH SYSTEM

This application is a divisional application of U.S. Pat. Application Serial No. 16/818,245, filed on Mar. 13, 2020, the disclosure of which is incorporated herein by reference in its entirety.

FIELD

This disclosure relates generally to a safety catch system.

BACKGROUND

In general, a scissor lift is configured to provide a platform that is movable to different heights via folding supports that are controlled, for example, by a hydraulic or a pneumatic system. However, there may be instances in which such a scissor lift may descend unintentionally and/or in an unsafe manner. For example, in the event that the hydraulic or pneumatic system fails, then the scissor lift may come crashing down unexpectedly, which may result in an unsafe situation and/or damage to an object when on the platform.

SUMMARY

The following is a summary of certain embodiments described in detail below. The described aspects are presented merely to provide the reader with a brief summary of these certain embodiments and the description of these aspects is not intended to limit the scope of this disclosure. Indeed, this disclosure may encompass a variety of aspects that may not be explicitly set forth below.

According to at least one aspect, a safety latch system includes a mount, a pawl member, a ratchet member, and a release assembly. The mount is mountable on a housing of a piston. The pawl member is coupled to the mount. The pawl member includes a pawl. The ratchet member has a first sidewall that includes a first connecting portion that is connectable to an end portion of a piston rod of the piston. The first sidewall includes a teeth portion, which is configured to engage with the pawl. The release assembly is configured to provide an engaged state between the pawl member and the ratchet member. The release assembly is also configured to provide a disengaged state between the pawl member and the ratchet member. When in the engaged state, the pawl member is engaged with the ratchet member such that the safety latch system is configured to provide (i) an unlocked state in which the ratchet member is movable relative to the pawl member as the piston rod advances outward from the housing and (ii) a locked state in which the pawl member is configured to lock into a depression between adjacent teeth of the ratchet member to stop the piston rod from moving towards the housing. When in the disengaged state, the pawl member is disengaged from the ratchet member to permit the piston rod to advance outward from the housing and permit the piston rod to retract towards the housing.

According to at least one aspect, a lift apparatus includes a platform, a scissor lift assembly, an actuator, and a safety latch system. The scissor lift assembly includes movable legs, which support the platform at various positions along a vertical axis. The actuator includes a piston and a piston rod. The actuator is configured to move the leg such that the platform is provided at the various positions along the vertical axis. The safety latch system is configured to provide a safety catch for the leg. The safety latch system includes a mount, a pawl member, a ratchet member, and a release assembly. The mount is mountable on a housing of a piston. The pawl member is coupled to the mount. The pawl member includes a pawl. The ratchet member has a first sidewall that includes a first connecting portion that connects to an end portion of the piston rod. The first sidewall includes a teeth portion that engages with the pawl. The ratchet member is configured to (i) move relative to the pawl in an unlocked state when the piston rod advances outward from the housing and (ii) lock relative to the pawl in a locked state to stop the piston rod from moving towards the housing. The release assembly is operably connected to the pawl member. The release assembly is configured to provide an engaged state between the pawl member and the ratchet member and a disengaged state between the pawl member and the ratchet member. When in the engaged state, the pawl member is engaged with the ratchet member such that the safety latch system is configured to provide the unlocked state and the locked state. When in the disengaged state, the pawl member is disengaged from the ratchet member to permit the piston rod to advance outward from the housing and permit the piston rod to retract towards the housing.

According to at least one aspect, a lift apparatus includes at least a platform, a leg, an actuator, and a safety latch system. The leg supports the platform at various positions along a vertical axis. The actuator includes a piston and a piston rod. The actuator is configured to move the leg such that the platform moves to various positions along the vertical axis. The safety latch system is configured provide an unlocked state and a locked state. The safety latch system includes a mount, a pawl member, a ratchet member, and a release assembly. The mount is mountable on a housing of the piston. The pawl member connects to the mount and includes a first pawl and a second pawl. The pawl member is movable into an engaged state and a disengaged state. The ratchet member includes a first sidewall with a first teeth portion and a second sidewall with a second teeth portion. The ratchet member is configured to provide (i) the unlocked state with the pawl member when in the engaged state such that the piston rod is configured to move the leg to raise the platform and (ii) the locked state with the pawl member when in the engaged state such that the piston rod is stopped from moving the leg to descend the platform. The release assembly is configured to transition the pawl member from the engaged state to the disengaged state such that the pawl member is disengaged from the ratchet member to enable the piston rod to move the leg to descend the platform.

These and other features, aspects, and advantages of the present invention are discussed in the following detailed description in accordance with the accompanying drawings throughout which like characters represent similar or like parts.

BRIEF DESCRIPTION OF THE DRAWINGS

FIG. 3B also shows an enlarged view of some teeth of the ratchet member according to an example embodiment.

DETAILED DESCRIPTION

Figure 1:
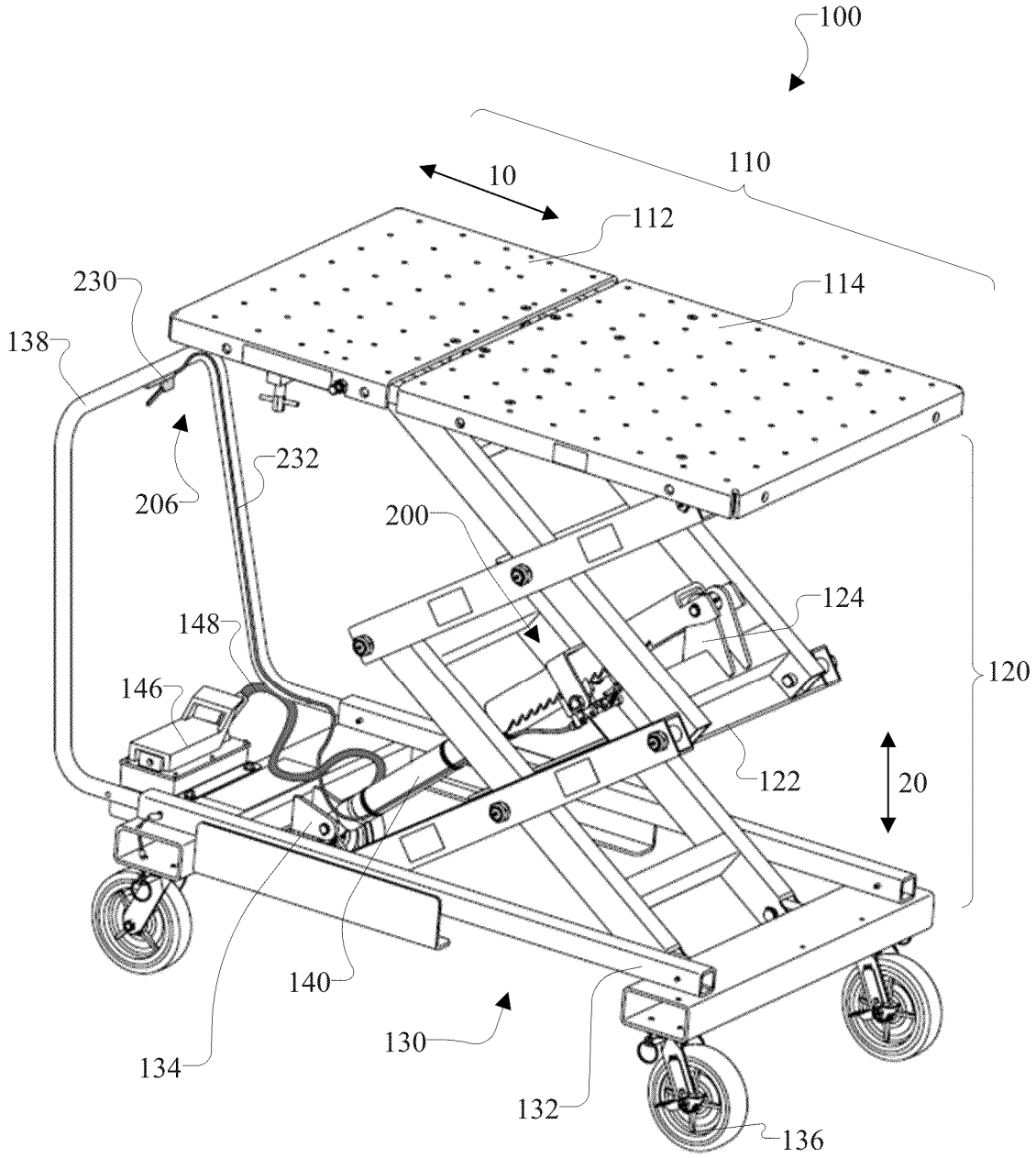
FIG. 1 is a diagram of an example of a lift apparatus with a safety latch system according to an example embodiment of this disclosure.

The embodiments described herein, which have been shown and described by way of example, and many of their advantages will be understood by the foregoing description, and it will be apparent that various changes can be made in the form, construction, and arrangement of the components without departing from the disclosed subject matter or without sacrificing one or more of its advantages. Indeed, the described forms of these embodiments are merely explanatory. These embodiments are susceptible to various modifications and alternative forms, and the following claims are intended to encompass and include such changes and not be limited to the particular forms disclosed, but rather to cover all modifications, equivalents, and alternatives falling with the spirit and scope of this disclosure.

FIGS. 1 and 2A-2C illustrate different views of a lift apparatus 100 with a safety latch system 200 according to an example embodiment. The lift apparatus 100 includes a platform 110, a support assembly 120, a base assembly 130, an actuator 140, and the safety latch system 200. For instance, as a non-limiting example, in FIG. 1, the lift apparatus 100 is a propulsion system lift, which is configured to provide the platform 110 as a movable work surface for various components, such as an electric vehicle battery, an engine, a transaxle, a fuel tank, a suspension, a cradle, a chassis system component, a powertrain, any suitable object, or any combination thereof.

The platform 110 is structured to provide a work surface. For example, in FIG. 1, the work surface includes a first portion 112 and a second portion 114. The work surface is adjustable to different lengths along a first axis 10. In this example, the first portion 112 is fixed in place. Meanwhile, the second portion 114 is movable, via rails or any suitable mechanical device, to different positions along the first axis 10 and configured to be locked into place at the desired position. The platform 110 is also movable along a second axis 20, which is perpendicular to the first axis 10. For example, in FIG. 1, the second axis 20 is a vertical axis. Advantageously, the platform 110 is structured to provide a work surface, which is adjustable to different lengths and different heights, thereby being suitable for various objects and/or tasks.

The support assembly 120 is structured to support the platform 110 at various positions along the second axis 20. For example, in FIG. 1, the support assembly 120 includes a four bar linkage structure. The support assembly 120 includes a scissor lift assembly, which includes folding supports with legs 122 that are movable to different positions to support the platform 110 at different heights along the second axis 20. As a non-limiting example, for instance, the scissor lift assembly includes a first pair of crossed legs 122 and a second pair of crossed legs 122, which are movable at the joints of the crossed parts and connected parts. The scissor lift assembly is configured to provide various states, such as a lowered state and a raised state, as well as intermediary states positioned between the lowered state and the raised state. In the lowered state, as shown in FIG. 2A, the scissor lift assembly has its legs 122 positioned to provide the platform 110 at a lower height. In the raised state, as shown in FIG. 2C, the scissor lift assembly has its legs 122 positioned to provide the platform 110 at a higher height, which is greater than the lower height. Also, the scissor lift assembly is configured to provide various states in which its legs 122 are positioned at various intermediary positions between the lowered state and the raised state. FIG. 2B illustrates an example of the scissor lift assembly at an intermediary position, which is between the lower height and the higher height.

The base assembly 130 includes any suitable structure that provides support to the other components of the lift apparatus 100. For instance, as a non-limiting example, in FIG. 1, the base assembly 130 includes a frame structure 132. The frame structure 132 includes a set of flanges 134, which is structured to connect with an end of the actuator 140. Also, in this example, the frame structure 132 includes wheels 136 (e.g., caster wheels) and a steering handle 138, which are advantageous in enabling the lift apparatus 100 to move to various locations with ease. As another example (not shown), the base assembly 130 is a stationary base or any suitable frame structure, which is configured to support the other components of the lift apparatus 100.

The actuator 140 is a hydraulic system, a pneumatic system, an electronic system, or any suitable actuation system that is enabled to provide the functions described herein. For example, in FIG. 1, the actuator 140 is a hydraulic cylinder, which has an end connected to the base assembly 130 and an opposite end connected to the support assembly 120. For instance, in FIG. 1, the hydraulic cylinder has a first mount at an end of its housing 142 secured to a set of flanges 134 of the base assembly 130 and a second mount at an end of its piston rod 144 secured to a set of flanges 124 of the leg 122 of the support assembly 120. This mounting of the hydraulic cylinder enables the hydraulic cylinder to be supported at one end of the housing 142 while enabling a movement of the piston rod 144 to drive the leg 122 to various positions to provide the platform 110 at various heights. The actuator 140 is configured to drive the support assembly 120 such that the platform 110 ascends or descends to the desired height with ease by an activation device, which may be any suitable simple machine. For example, in FIG. 1, the activation device is a pedal 146 (or lever), which is operably connected to the actuator 140 via a cable 148.

The safety latch system 200 is configured to provide a safety catch for the actuator 140 and/or the support assembly 120. The safety latch system 200 includes at least a ratchet member 202, a pawl assembly 204, and a release assembly 206. The safety latch system 200 is configured to be installed during assembly of the lift apparatus 100 and/or retrofitted after assembly of the lift apparatus 100. When installed, the safety latch system 200 is configured to provide an engaged state in which the pawl assembly 204 is engaged with the ratchet member 202 and a disengaged state in which the pawl assembly 204 is disengaged from the ratchet member 202. For example, in FIG. 1, the safety latch system 200 is in an engaged state when the release assembly 206 is not activated (or in a default state) via a lever 230 and a disengaged state when the release assembly 206 is activated via the lever 230.

In addition, when in the engaged state, the safety latch system 200 is advantageously configured to provide an unlocked state and a locked state. In the unlocked state, the safety latch system 200 is configured to enable the actuator 140 to drive the legs 122 such that the platform 110 is enabled to ascend. In the locked state, the safety latch system 200 is configured to stop the actuator 140 and/or the legs 122 from descending so that the platform 110 does not descend or continue to descend beyond a threshold amount (e.g., predetermined backlash amount) as a safety measure. In contrast, when in the disengaged state, the safety latch system 200 is switchable between the locked state and the unlocked state. For example, when in the disengaged state, the safety latch system 200 is configured to transition from the locked state to the unlocked state such that the legs 122 and/piston rod 144 can move (e.g., descend and ascend) the platform 110 freely to various heights since the pawl assembly 204 is disengaged from the ratchet member 202.

Figure 3A:
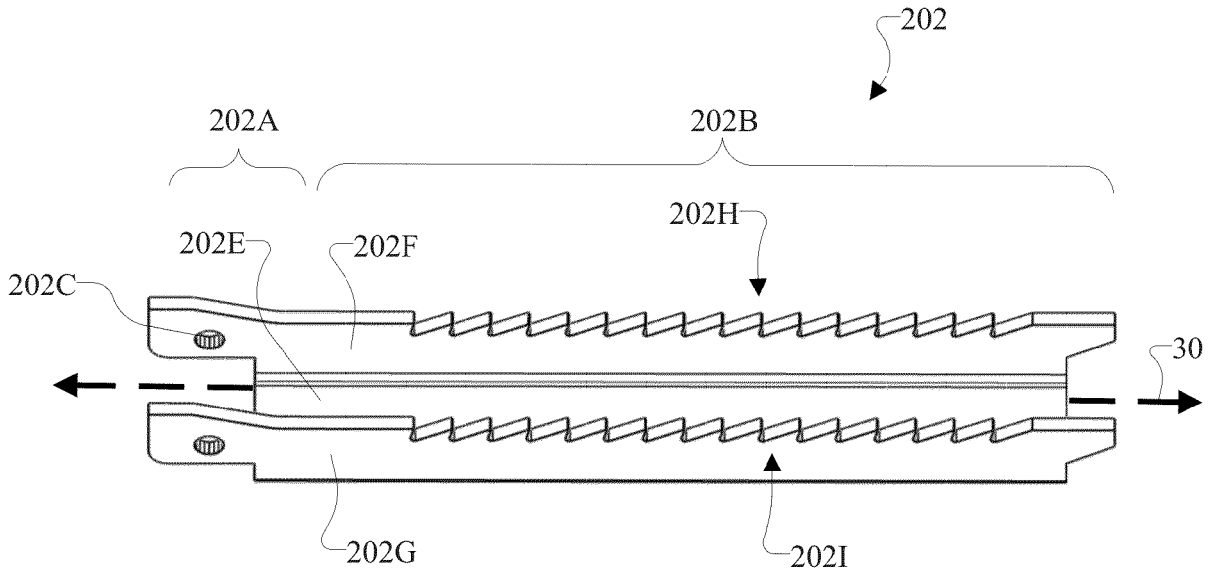
FIG. 3A is a perspective view of an example of the ratchet member according to an example embodiment.
Figure 3B:
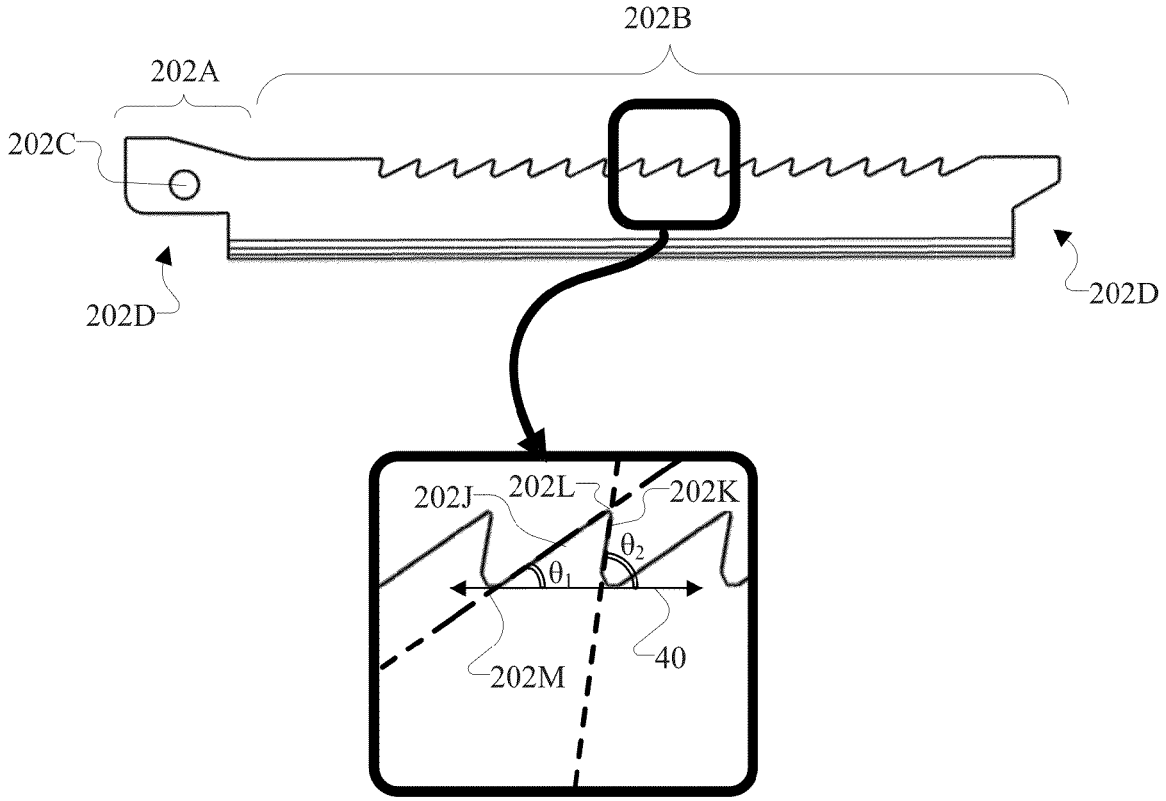
FIG. 3B is a side view of an example of the ratchet member according to an example embodiment.

FIGS. 3A and 3B illustrate various views of the ratchet member 202 according to an example embodiment. The ratchet member 202 is an elongated member. In this example, the ratchet member 202 is symmetrical about its longitudinal axis 30. The ratchet member 202 includes a first portion 202A and a second portion 202B. The first portion 202A includes a connection mechanism, which enables the ratchet member 202 to be connected to the support assembly 120 and the actuator 140. In this example, the ratchet member 202 includes through-holes 202C, which serve as the connecting mechanism that enables at least one fastener to secure the ratchet member 202 to the support assembly 120 and the actuator 140.

Figure 2A:
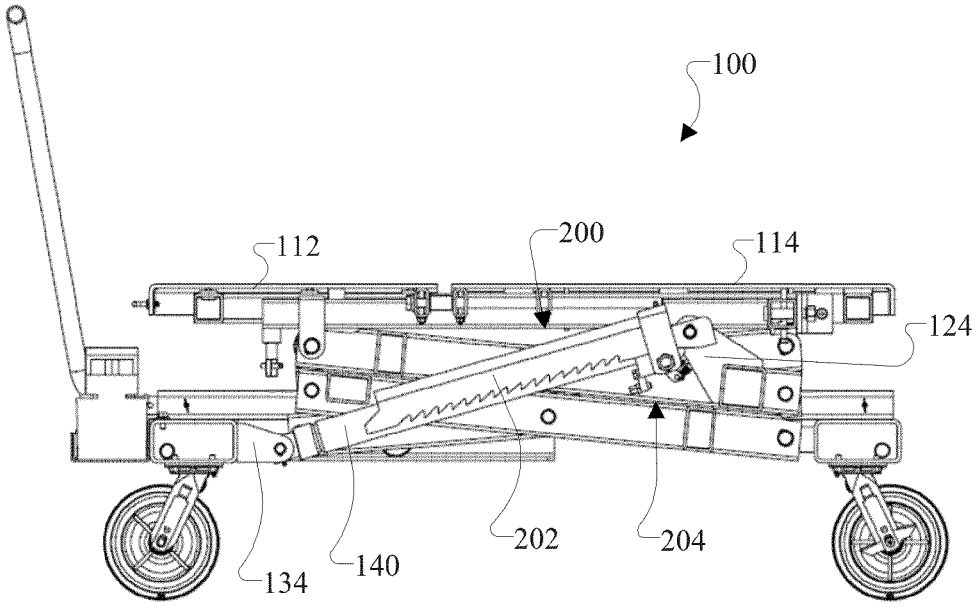
FIG. 2A is a diagram of an example of a lift apparatus with a safety latch system in which a platform is at a lowest position according to an example embodiment of this disclosure.
Figure 2B:
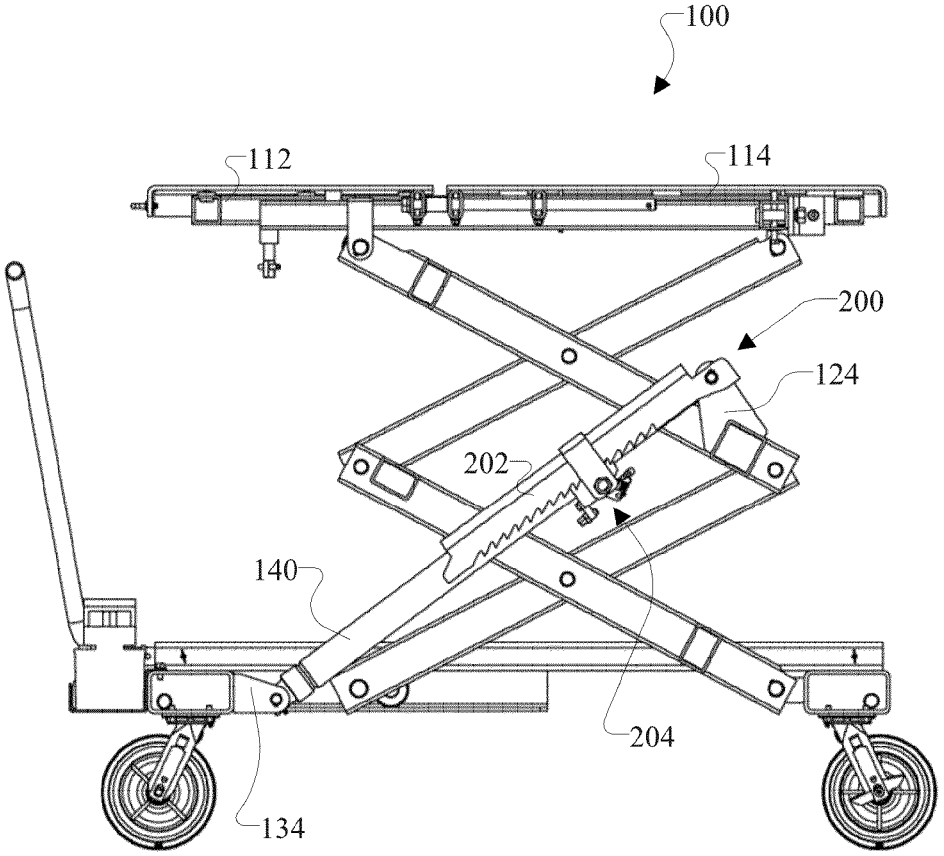
FIG. 2B is a diagram of an example of a lift apparatus with a safety latch system in which a platform is at an intermediary position according to an example embodiment of this disclosure.
Figure 2C:
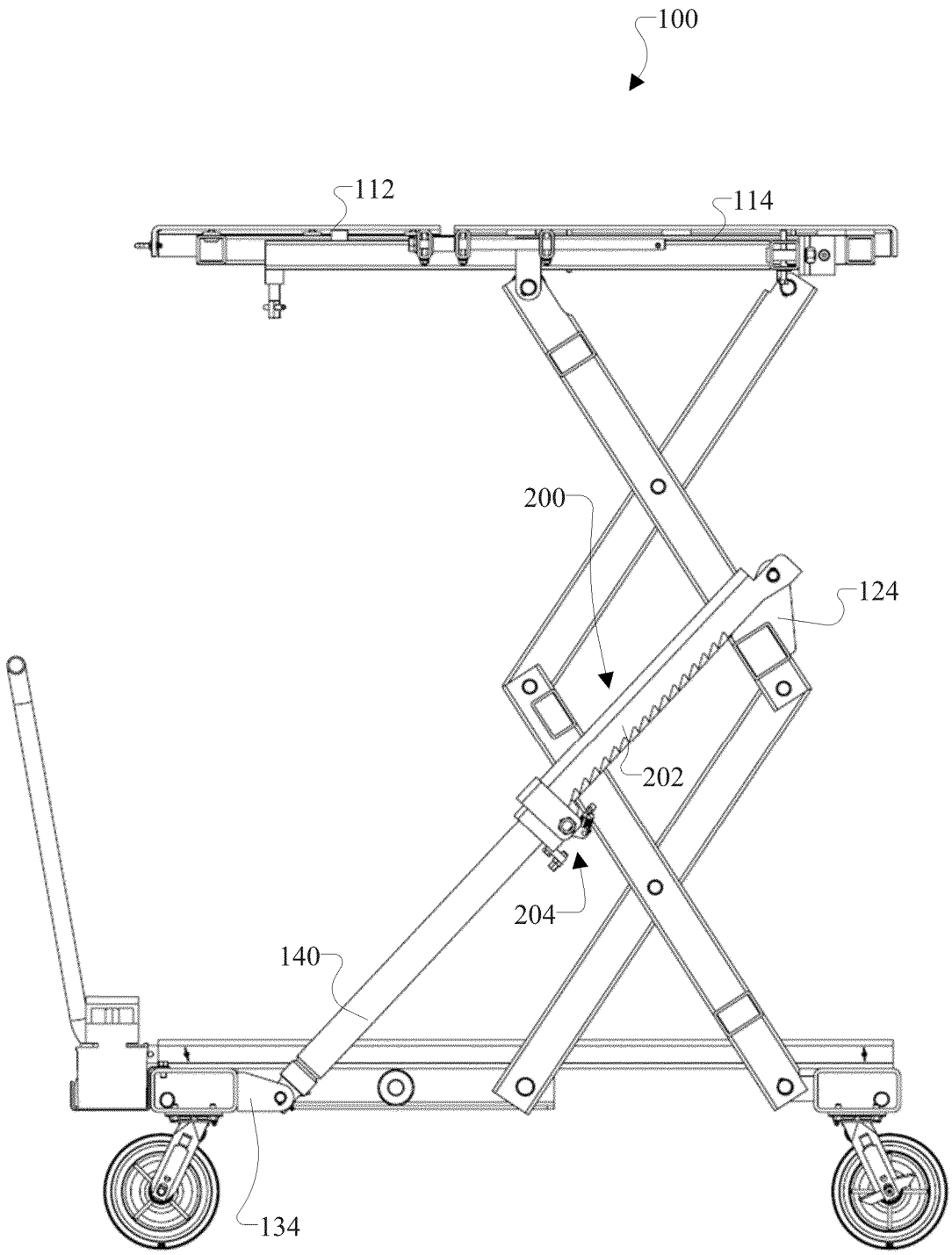
FIG. 2C is a diagram of an example of a lift apparatus with a safety latch system in which a platform is at a highest position according to an example embodiment of this disclosure.

For example, as shown in FIG. 1, the ratchet member 202 is structured to receive the set of flanges 124 between its inner sidewalls. In addition, the set of flanges 124 are structured to receive an end portion of the piston rod 144 between its inner surfaces. Also, as shown in FIG. 1, the piston rod 144, the leg 122, and the ratchet member 202 are secured to each other by the same mechanical fasteners, such as a pin, a retaining ring, any suitable mechanical fastener, or any combination thereof. With this configuration, the actuator 140 is configured to drive the leg 122 and the ratchet member 202 to move in accordance with a movement of the piston rod 144. Meanwhile, the second portion 202B includes a free end, thereby enabling the ratchet member 202 to move in accordance with its attachment at the first portion 202A to the piston rod 144 and the leg 122. In addition, the ratchet member 202 may include cut-out portions 202D. For example, as shown in FIG. 3B, these cut-out portions 202D are advantageous in providing clearance for the ratchet member 202 with respect to neighboring components. In addition, the cut-outs 202D provide material-saving and cost-saving benefits.

In an example embodiment, the ratchet member 202 is a channel-type of structure that has a U-shaped or C-shaped cross-section. For example, as shown in FIG. 3A, the ratchet member 202 is a three-sided structure, which includes a central wall portion 202E, which extends between a first sidewall portion 202F and a second sidewall portion 202G. This three-sided configuration provides the ratchet member 202 with strength and rigidity. In FIG. 3A, the ratchet member 202 is a monolithic structure, but the ratchet member 202 may include a plurality of elements that form a unitary structure. The ratchet member 202 comprises a material of high tensile strength. For example, in at least FIGS. 1 and 3A-3B, the ratchet member 202 comprises steel or any suitable material that enables the ratchet member 202 to provide the functions described herein.

The central wall portion 202E is between the first sidewall portion 202F and the second sidewall portion 202G. The central wall portion 202E provides a connection between the first sidewall portion 202F and the second sidewall portion 202G to ensure that the first sidewall portion 202F is aligned with the second sidewall portion 202G. The central wall portion 202E is also structured to protect and cover underlying components from foreign matter (e.g., debris, liquid, other objects, etc.), thereby ensuring proper functioning of the safety latch system 200.

The first sidewall portion 202F includes a first teeth portion 202H. The first teeth portion 202H includes a first set of teeth. In addition, the second sidewall portion 202G includes a second teeth portion 202I. In this case, each tooth of the second teeth portion 202I corresponds to each tooth of the first teeth portion 202H. Also, in this case, the first teeth portion 202H is identical or similar to the second teeth portion 202I with respect to, for example, number of teeth, profile of teeth, position of teeth, etc. The second teeth portion includes a second set of teeth. The second teeth portion 202I are aligned with and correspond to the first teeth portion 202H via the central wall portion 202E. Moreover, as shown in the enlarged view of FIG. 3B, each tooth includes a first inclined surface 202J and a second inclined surface 202K, which form a tip 202L. The first inclined surface 202J forms a first angle $\theta 1$ with respect to a base line 40 of the tooth. The second inclined surface 202K forms a second angle $\theta 2$ with respect to the base line 40 of the tooth. The second angle $\theta 2$ is greater than the first angle $\theta 1$. In this regard, the second inclined surface 202K is steeper than the first inclined surface 202J. Between each set of adjacent teeth, there is a depression 202M, where the respective pawl is enabled to lock into place when in the locked state.

Figure 4A:
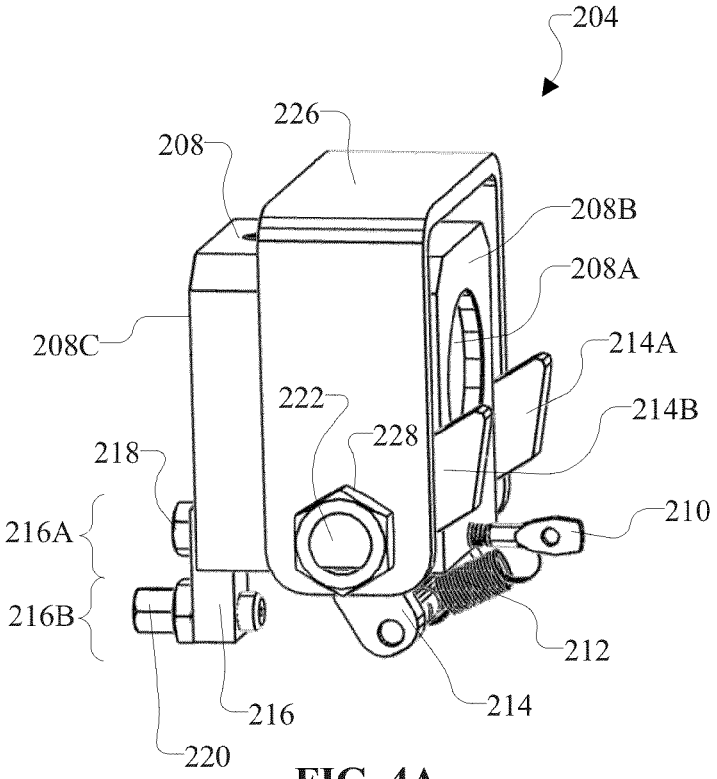
FIG. 4A is a perspective view of an example of a pawl assembly according to an example embodiment.
Figure 4B:
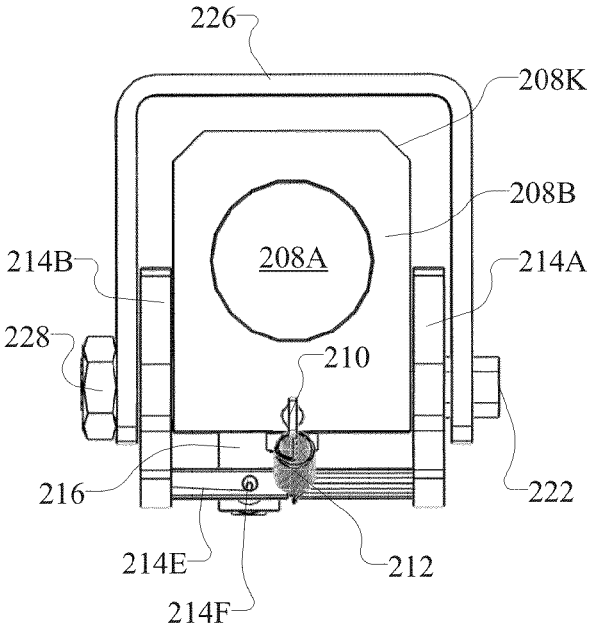
FIG. 4B is a view of one side of the pawl assembly of FIG. 4A according to an example embodiment.
Figure 4C:
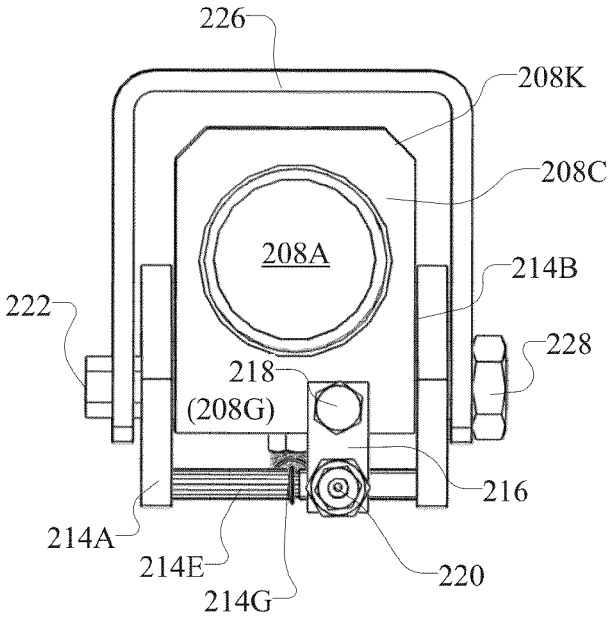
FIG. 4C is a view of another side of the pawl assembly of FIG. 4A according to an example embodiment.
Figure 4D:
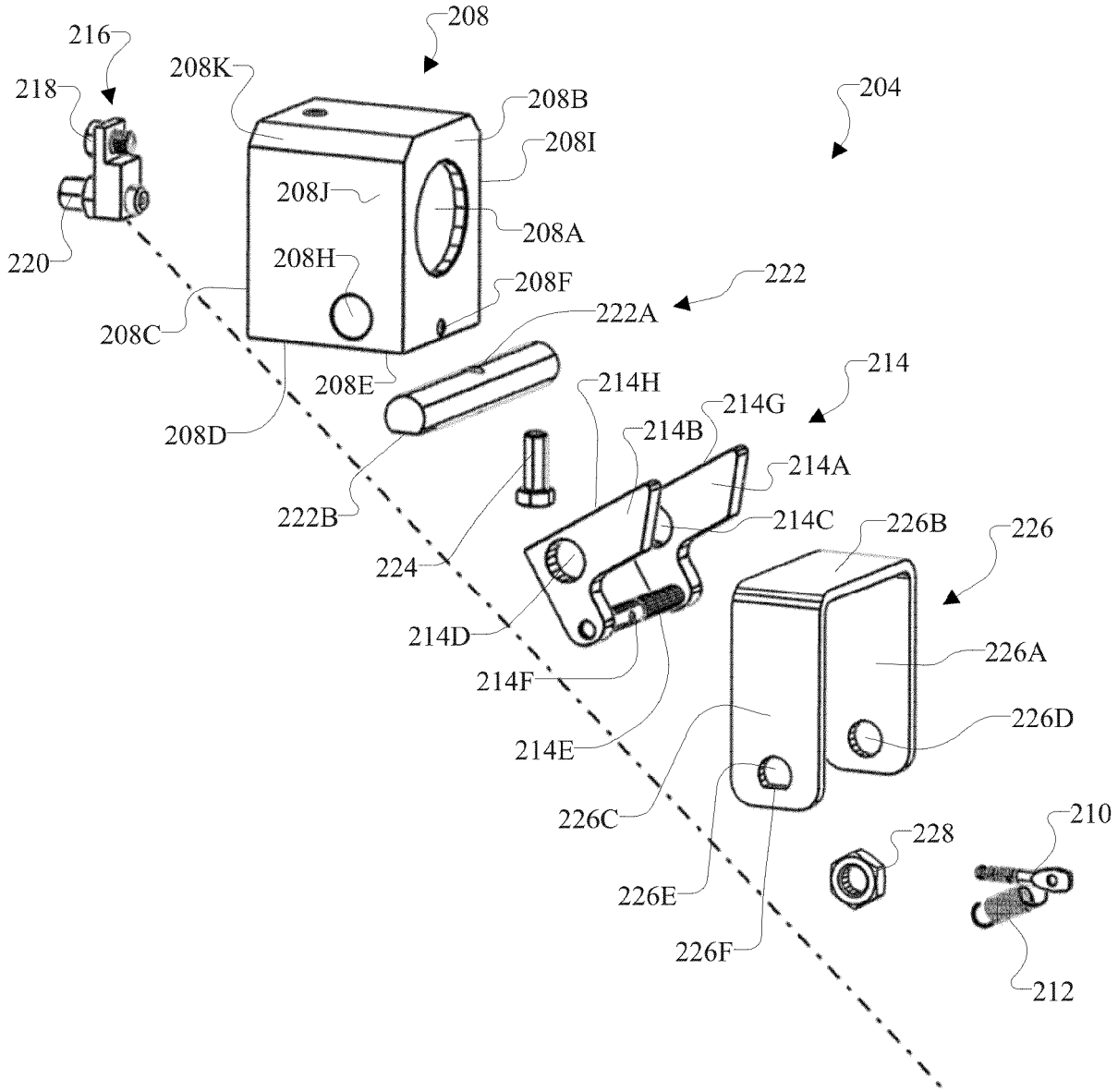
FIG. 4D is an exploded view of the components of the pawl assembly of FIG. 4A according to an example embodiment.

FIGS. 4A-4D illustrate various views of the pawl assembly 204 according to an example embodiment. The pawl assembly 204 includes at least a mount 208. For example, in FIGS. 4A-4D, the mount 208 comprises steel or any suitable material that enables the mount 208 to provide the functions described herein. The mount 208 is mountable to a housing 142 of the piston at a portion, which is adjacent to an opening where the piston rod 144 extends and retracts from the housing 142. For example, as shown in FIGS. 4A-4D, the mount 208 is a block with a rectangular cross-section or a substantially rectangular cross-section. The mount 208 includes a through-hole 208A that extends from a first surface 208B to a second surface 208C. The mount 208 is mountable to an outer portion of the housing 142 by receiving and enabling a part of the actuator 140 to pass through the through-hole 208A. The mount 208 is configured to be secured to the housing 142 via fasteners (e.g., set screws or the like). In addition, as shown in FIG. 4D, the mount 208 includes a surface 208D with a hole 208E to receive a fastener 224, such as a set screw or any suitable fastening device, which secures a rod 222 to the mount 208.

Figure 6:
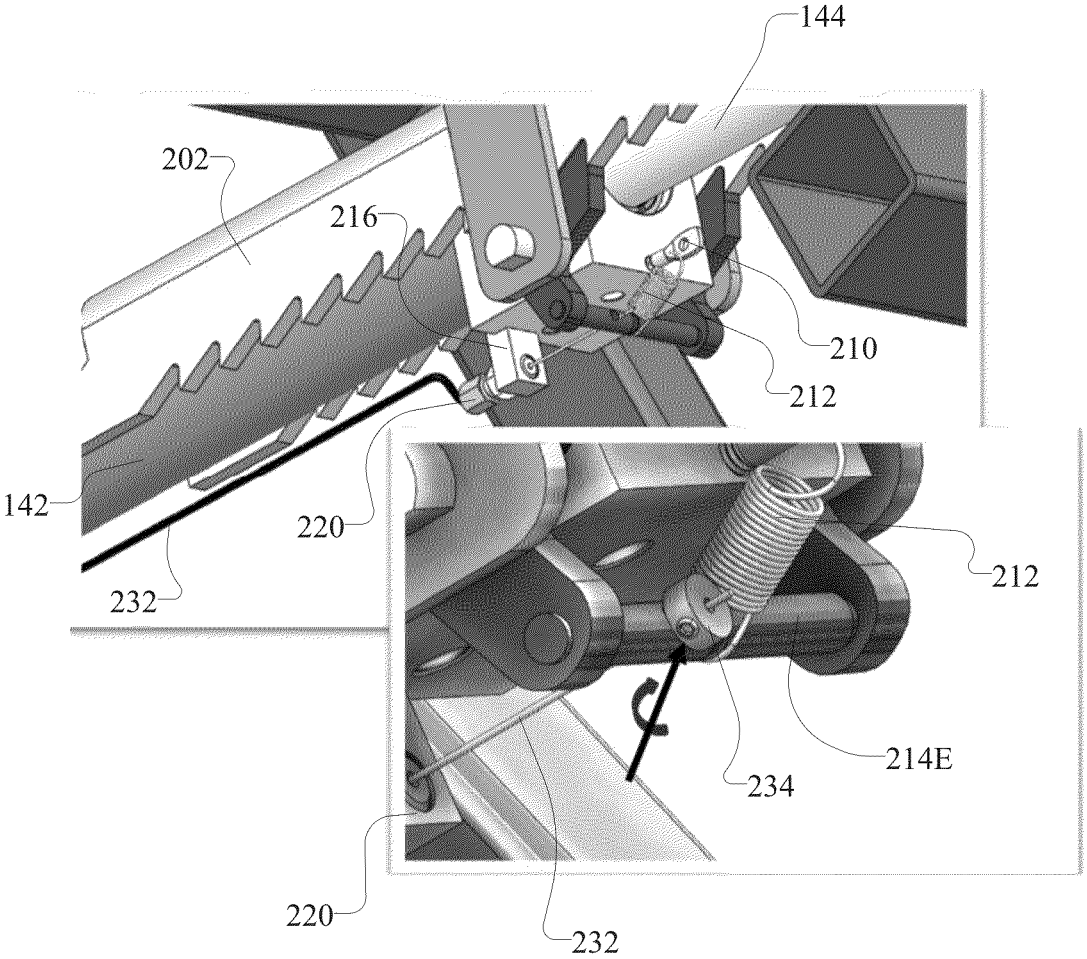
FIG. 6 is a perspective view and an enlarged view of some components of the release assembly in relation to the pawl assembly according to an example embodiment.

The mount 208 is configured to connect to a spring anchor 210. For example, the first surface 208B of the mount 208 includes a hole 208F to receive a spring anchor 210. The spring anchor 210 enables a spring 212 to be mounted to the mount 208. The spring anchor 210 enables the spring 212 to be adjusted with ease. For example, as shown in FIG. 6, the spring anchor 210 is configured to fix one end of the spring 212 to the mount 208 while the other end of the spring 212 is connected to the pawl member 214. This configuration enables the spring 212 to be fixed at the mount 208 and movable with the pawl member 214. The spring 212 is thus configured to bias or urge the pawl member 214 to interact with the ratchet member 202 unless the lever 230 is activated. In FIGS. 4A-4D, the spring 212 is an extension spring. As other examples, the spring 212 may include at least one torsional spring or any suitable mechanical device that provides the functionality described herein.

The mount 208 is configured to connect to a cable holder 216. For example, on the second surface 208C, the mount 208 includes a hole 208G to receive a fastener 218, which secures the cable holder 216 to the mount 208. As shown in at least FIG. 4A, when mounted to the mount 208, the cable holder 216 has a first portion 216A that receives the fastener 218, which secures the cable holder 216 to the mount 208. In addition, as shown in FIG. 4A, the cable holder 216 includes a second portion 216B that extends beyond a surface of the mount 208. The second portion 216B is structured to receive the cable connector 220. As such, in this example, the second portion 216B is thicker than the first portion 216A, as shown in FIG. 4D, thereby providing a ledge where the corner portion of the mount 208 contacts and/or mates with the cable holder 216. Also, as shown in FIGS. 4A, 4C-4D and 6, when mounted to the mount 208, the cable holder 216 holds the cable connector 220 at a position that enables a cable 232 to connect to a bar 214E of the pawl member 214.

The mount 208 is also configured to receive a rod 222, which is configured to support at least the pawl member 214. The rod 222 is also configured to support the guide member 226. In this regard, for example, the rod 222 comprises a material of high tensile strength. For example, the rod 222 comprises cold drawn 114 steel or any suitable material that is enabled to provide the functions described herein. As shown in at least FIG. 4D, the mount 208 has a through-hole 208H extending from a first lateral surface 208I to a second lateral surface 208J. With this configuration, a longitudinal axis of the rod 222 is configured to extend perpendicular to a longitudinal axis of the actuator 140. The rod 222 is structured to be longer than the mount 208 such that a first end portion of the rod 222 extends beyond a first lateral surface 208I of the mount 208 and a second end portion of the rod 222 extends beyond a second lateral surface 208J of the mount 208. The rod 222 is structured to receive the fastener 224, such as the set screw or any suitable fastening device, which is configured to secure the rod 222 to the mount 208. For example, in FIG. 4D, the rod 222 includes the through-hole 222A at a center region of the rod 222 so that the fastener 224 is enabled to secure the rod 222 to the mount 208 in a stable manner. The rod 222 includes a major portion that is cylindrical and a minor portion that has a flat surface 222B on at least one end portion to provide a D-shaped cross-section. The cylindrical portion enables the pawl member 214 to rotate into various positions, such as a first position to provide the engaged state and a second position to provide the disengaged state. The flat surface 222B provides an abutment surface to prevent the rod 222 and/or the guide member 226 from rotating relative to each other.

The mount 208 is configured to support the pawl member 214 via end portions of the rod 222, which include round cross-sections and are exposed from the mount 208. The pawl member 214 comprises steel or any suitable material that enables the pawl member 214 to provide the functions described herein. The pawl member 214 includes at least one pawl. For example, in FIGS. 4A-4D, the pawl member 214 has a plurality of pawls including a first pawl 214A and a second pawl 214B. For example, as shown in FIG. 4D, the first pawl 214A is identical or substantially identical to the second pawl 214B.

In an example embodiment, the first pawl 214A has an L-shape that includes a first arm and a second arm. The first pawl 214A includes a first through-hole 214C to receive the rod 222 at a portion where the first arm is joined to the second arm. In addition, the first arm includes a tip portion that has a shape that enables the first pawl 214A to mate with and mesh with the first teeth portion 202H at any one of its depressions 202M. The second arm of the first pawl 214A includes an end portion that is connected to or joined with the bar 214E. Also, the second pawl 214B has an L-shape that includes a first arm and a second arm. The second pawl 214B includes a second through-hole 214D to receive the rod 222 at a portion where the first arm is joined to the second arm. In addition, the first arm includes a tip portion that has a shape that enables the second pawl 214B to mate with and mesh with the second teeth portion 202I at any one of its depressions 202M. The second arm of the second pawl 214B includes an end portion that is connected to or joined with the bar 214E.

The first pawl 214A and the second pawl 214B are spaced apart from each other while being connected to each other via the bar 214E. In this regard, the first pawl 214A is structured to be positioned on one side of the mount 208 while the second pawl 214B is configured to be positioned on an opposite side of the mount 208. More specifically, as shown in FIGS. 4A-4D, the first pawl 214A is positioned adjacent to an outer side of the first lateral surface 208I while the second pawl 214B is positioned adjacent to an outer sider of the second lateral surface 208J.

Figure 7A:
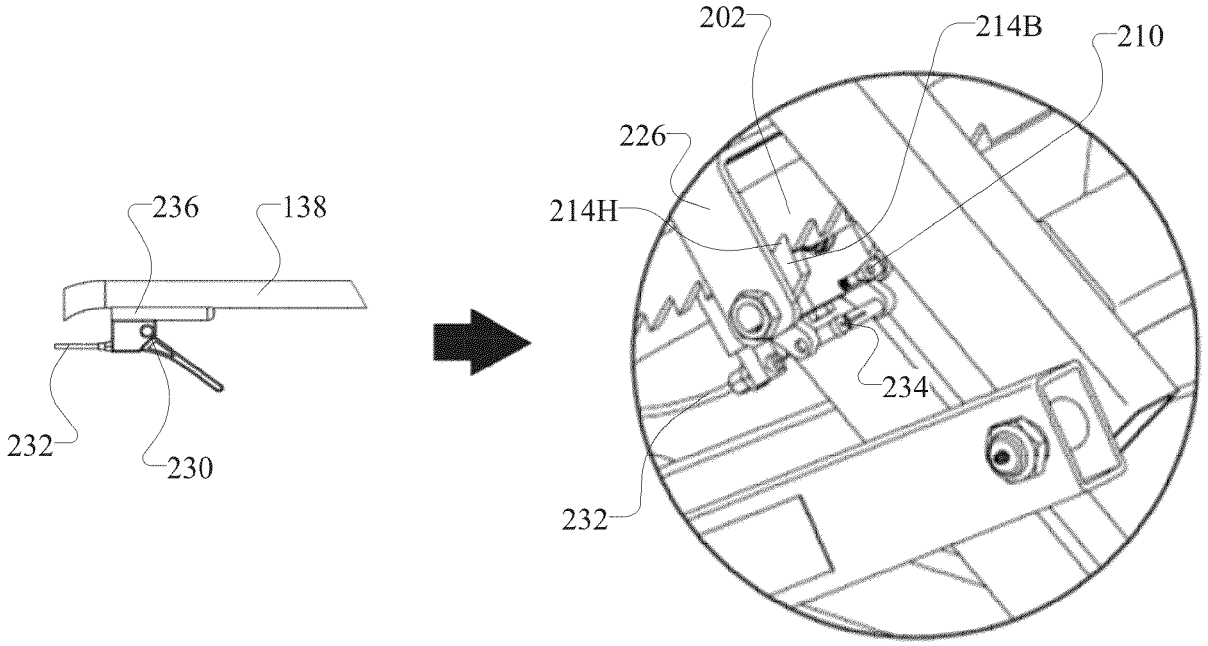
FIG. 7A is a conceptual diagram that shows a state of the safety latch system when the lever is not activated according to an example embodiment.

Each of the first pawl 214A and the second pawl 214B are configured to interact with the ratchet member 202. As shown in at least FIG. 4A, when connected to the mount 208, the first pawl 214A and the second pawl 214 are each structured to extend beyond the first surface 208B of the mount 208. For example, as shown in FIGS. 4A and 7A, when in the engaged state, the pawl member 214 is configured to rotate into at least a first position in which the first edge 214G of the first pawl 214A and the second edge 214H of the second pawl 214B are angled with respect to at least the first surface 208B such that they are enabled to interact with the first teeth portion 202H and the second teeth portion 202I of the ratchet member 202. Also, as shown in at least FIG. 7B, when in the disengaged state, the pawl member 214 is configured to rotate into at least a second position in which the first edge 214G and the second edge 214H are perpendicular (or substantially perpendicular) with respect to at least the first surface 208B such that they are spaced and disengaged from the first teeth portion 202H and the second teeth portion 202I of the ratchet member 202.

In this example, the first pawl 214A and the second pawl 214B are structured to move together in unison. The pawl member 214 includes the bar 214E (or any suitable mechanical device) that extends between the first pawl 214A and the second pawl 214B. The bar 214E connects the first pawl 214A and the second pawl 214B to each other. The bar 214E also aligns the first pawl 214A to the second pawl 214B. The bar 214E provides a structure by which the release assembly 206 is enabled to connect to the pawl member 214 to control its state (e.g., engaged state and disengaged state). For example, in FIG. 4D, the bar 214E includes a through-hole 214F to receive the cable 232 (FIG. 6) of the release assembly 206. The bar 214E also includes a groove 214G to enable the spring 212 to connect to the pawl member 214 to control the pawl member 214. Also, as shown in FIGS. 4A-4C, when the pawl member 214 is mounted on the mount 208, the pawl member 214 is structured to have its bar 214E extend below the mount 208 with sufficient clearance to enable the bar 214E to move in accordance with the release system 206 and the spring 212, respectively. Furthermore, the pawl member 214 is configured such that its bar 214E is positioned closer to the spring anchor 210 when the pawl member 214 is in the first position and in the engaged state than when the pawl member 214 is in the second position and in the disengaged state.

The pawl assembly 204 includes a guide member 226. The guide member 226 is configured to guide the ratchet member 202 in relation to the pawl member 214 as the ratchet member 202 moves with the actuator 140 and/or the leg 122. The guide member 226 is structured to guide and align the ratchet member 202 with the pawl member 214 such that the first teeth portion 202H interacts with the first pawl 214A and the second teeth portion 202I interacts with the second pawl 214B, respectively. The guide member 226 comprises steel or any suitable material that enables the guide member 226 to provide the functions described herein.

The guide member 226 is a three-sided structure that includes a first side 226A, a second side 226B, and a third side 226C. The guide member 226 includes rounded interior corner portions, which are structured to provide some clearance for the ratchet member 202 so that the ratchet member 202 is configured to move relative to the guide member 226 without interference. In addition, the mount 208 is also structured to include beveled edges 208K to provide some clearance for the ratchet member 202 so that the ratchet member 202 is configured to move relative to the guide member 226 without interference from the mount 208.

The guide member 226 includes a first connecting portion 226D and a second connecting portion 226E. For instance, in the example shown in FIG. 4D, the first connecting portion 226D includes a through-hole of a round shape to correspond to the cylindrical portion of the rod 222. The first connecting portion 226D is not limited to this shape and may comprise any suitable shape in accordance with the correponding portion of the rod 222. The second connecting portion 226E includes a D-shaped through-hole to correspond to the D-shaped portion of the rod 222. The D-shape provides the third side 226C with a flat surface 226F, which is structured to prevent a rotation of the guide member 226 when the flat surface 226F abuts against the flat surface 222B of the rod 222. In addition, in the illustrated examples, the pawl member 214 and the guide member 226 are secured to the rod 222 via a fastener 228. Alternatively, the guide member 226 may be secured to the mount 208 separately from the pawl member 214 so long as the guide member 214 is configured to provide the same functions as described herein.

Figure 5A:
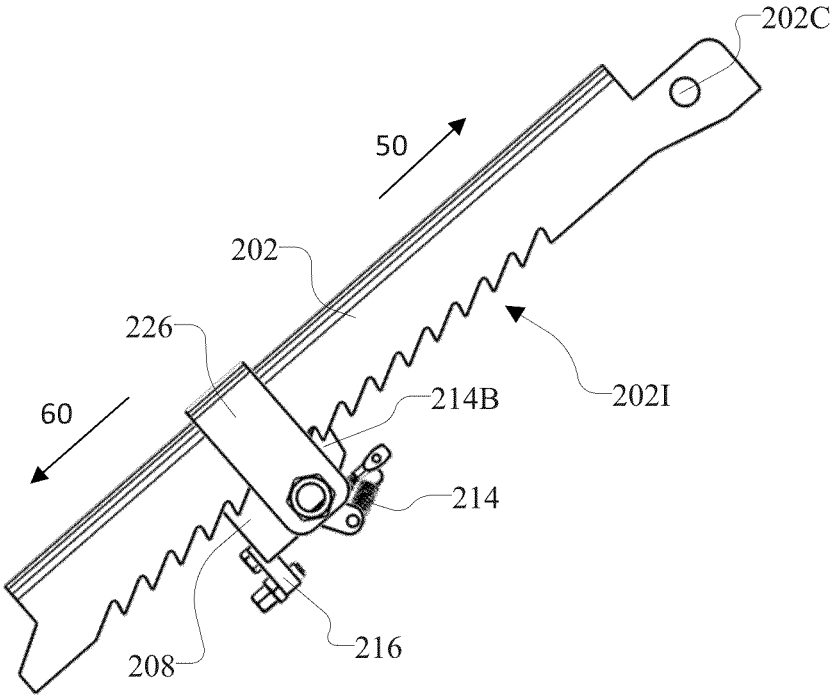
FIG. 5A is a side view of the ratchet member in relation to the pawl assembly according to an example embodiment.
Figure 5B:
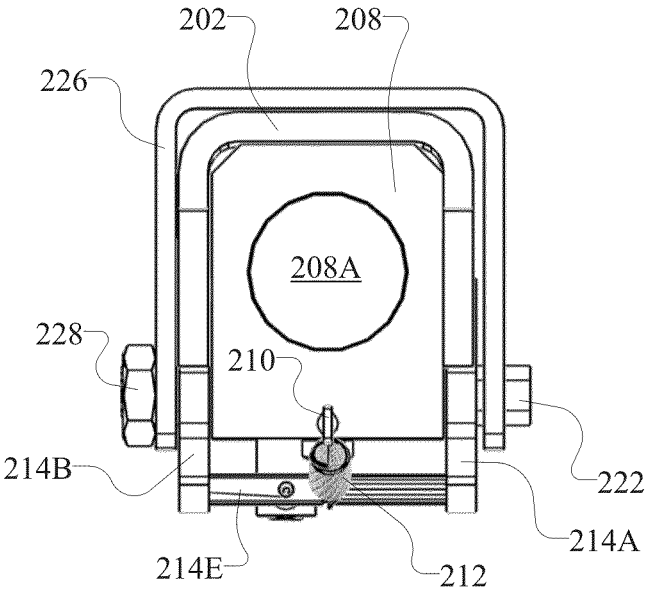
FIG. 5B is another side view of the ratchet member and the pawl assembly of FIG. 5A according to an example embodiment.

FIGS. 5A and 5B illustrate views of the ratchet member 202 in relation to the pawl assembly 204. As aforementioned, the ratchet member 202 is configured to move relative to the pawl member 214. For example, the ratchet member 202 is configured to move with the piston rod 144 as the piston rod 144 advances outward from the housing 142. In this regard, for instance, the ratchet member 202 is configured to move in at least a first direction 50 with respect to the pawl assembly 204. When the ratchet member 202 is driven by the piston rod 144 as the piston rod 144 advances outward from the housing 142, the first pawl 214A slides up and over the sloped edges of the first teeth portion 202H, with the spring 212 forcing the first pawl 214A (often with an audible 'click') into a depression 202M between a set of adjacent teeth as the first pawl 214A passes a tip portion (or peak) of each tooth of the first teeth portion 202H. In addition, when the ratchet member 202 is driven by the piston rod 144 as the piston rod 144 advances outward from the housing 142, the second pawl 214B slides up and over the sloped edges of the second teeth portion 202I, with the spring 212 forcing the second pawl 214B (often with the audible 'click') into a depression 202M between a set of adjacent teeth as the second pawl 214B passes a tip portion (or peak) of each tooth of the second teeth portion 202I.

In addition, when the safety latch system 200 is in the disengaged state via the lever 230, the ratchet member 202 is configured to move with the piston rod 144 as the piston rod 144 retracts toward the housing 142. In this regard, the ratchet member 202 is configured to move in at least a second direction 60, which is opposite to at least the first direction 50. In contrast, when the safety latch system 200 is in the engaged state via the lever 230, the first pawl 214A is configured to catch or abut against the first inclined surface 202J of the first tooth that the first pawl 214A encounters in the first teeth portion 202H when the piston rod 144 begins to retract or move towards the housing 142 and the mount 208. In addition, the second pawl 214B is configured to catch or abut against the first inclined surface 202J of the first tooth that the second pawl 214B encounters in the second teeth portion 202I when the piston rod 144 begins to retract or move towards the housing 142 and the mount 208. More specifically, the spring 212 is configured to bias the first pawl 214A and the second pawl 214B into depressions 202M between a set of adjacent teeth in the first teeth portion 202H and the second teeth portion 202I respectively such that the first pawl 214A and the second pawl 214B stop the ratchet member 202 (and thus the piston rod 144) from retracting or moving towards the housing 142 and the mount 208. In this scenario, the first pawl 214A is meshed between a set of adjacent teeth in the first teeth portion 202H while the second pawl 214B is meshed between a set of adjacent teeth in the second teeth portion 202I. This locked state, which includes a meshing or mating action by the ratchet member 202 and the pawl member 214, provides a measure of safety by stopping a descent or a continued descent of at least the actuator 140, the support assembly 120, and the platform 110.

In addition, the movement of the ratchet member 202 relative to pawl member 214 is shown, for example, in at least FIGS. 2A-2C. More specifically, in FIGS. 2A-2C, as aforementioned, the ratchet member 202 has one end connected to the piston rod 144 and leg 122 while having the opposite end free such that the ratchet member 202 is enabled to move with the piston rod 144 and/or the leg 122. Meanwhile, the pawl member 214 is mounted to the housing 142 of the piston via the mount 208 and is therefore fixed in its position along the actuator 140, but is rotatable into at least a first position to provide the engaged state in which the pawl member 214 is engaged with the ratchet member 202 and a second position to provide a disengaged state in which the pawl member 214 is disengaged from the ratchet member 202.

With this configuration, the ratchet member 202 is configured to move with respect to the pawl assembly 204 (and thus the pawl member 214). For example, in FIG. 2A, the pawl assembly 204 is positioned at an end portion of the ratchet member 202. In this case, the piston rod 144 is disposed and/or retracted within the housing 142 such that the end of the first portion 202A of the ratchet member 202 is located near the fixed position of the mount 208 on the housing 142. As another example, FIG. 2B illustrates an instance in which the pawl assembly 204 is positioned at an intermediary position along the ratchet member 202 as the ratchet member 202 has moved from its position at FIG. 2A to its position at FIG. 2B in accordance with a movement of the piston rod 144 in the first direction 50 (or an extension of the piston rod 144 from the housing 142). Furthermore, as yet another example, FIG. 2C illustrate an instance in which the pawl assembly 204 is positioned at an opposite end portion of the ratchet member 202 as the ratchet member 202 has moved from its position at FIG. 2B to its position at FIG. 2C in accordance with further movement of the piston rod 144 in the first direction 50 (or further extension of the piston rod 144 from the housing 142).

The release assembly 206 includes at least the lever 230, the cable 232, and the cable stopper 234. The lever 230 is configured to connect to any suitable part of the lift apparatus 100 via an attachment device 236 (FIGS. 7A-B) so that a user may activate or deactivate the lever 230 with ease. For example, as shown in FIG. 1, the lever 230 is configured to detachably couple to any ferromagnetic part (e.g., steering handle 138) of the lift apparatus 100 via magnets, which are provided as a part of the attachment device 236. The lever 230 is operably connected to the cable 232.

FIG. 6 illustrates a view of the cable 232 and its connection to the pawl assembly 204 according to an example embodiment. In this example, the cable 232 has a first portion connected to the lever 230 (FIG. 1) and a second portion connected to the cable connector 220 (FIG. 6). FIG. 6 shows the cable 232 with a protective sheath between the lever 230 and the cable connector 220 and without the protective sheath between the cable connector 220 and the bar 214E. The lever 230 is configured to pull on the cable 232 when the lever 230 is activated. The lever 230 is also configured to release its pull on the cable 232 when the lever 230 is not activated. The cable holder 216 is structured to provide stable support to the cable 232 with respect to the mount 208. The cable 232 is operably connected to the pawl member 214 to transmit its pull of the cable 232 to the pawl member 214 when the lever 230 is activated (FIG. 7B) and release its pull of the cable 232 to the pawl member 214 when the lever 230 is deactivated (FIG. 7A). For instance, in FIG. 6, the cable 232 is connected to the middle section of the bar 214E by passing through a through-hole 214F of the bar 214E and being fastened by a fastener 234 (e.g., cable stopper). The lever 230, via the cable 232, is therefore configured to control a movement of the bar 214E such that the pawl member 214 rotates about the rod 222 into a position to provide at least an engaged state with respect to the ratchet member 202 and another position to provide a disengaged state with respect to the ratchet member 202.

Figure 7B:
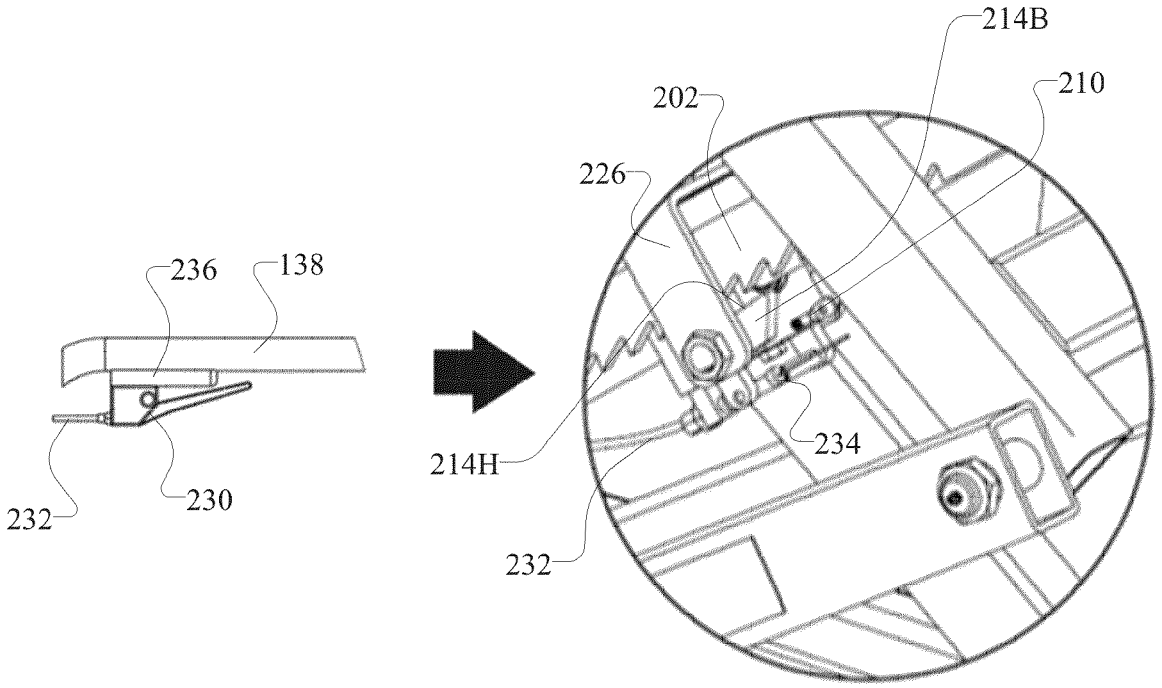
FIG. 7B is a conceptual diagram that shows a state of the safety latch system when the lever is activated according to an example embodiment.

FIGS. 7A and 7B show different states of the release assembly 206 according to an example embodiment. When the lever 230 is deactivated (i.e., not activated state or a default state), as shown in FIG. 7A, the lever 230 is configured to release its pull on the pawl member 214 via the cable 232 such that the spring 212 urges the pawl member 214 to engage with the ratchet member 202. When in this engaged state, the pawl member 214 rotates about the rod 222 such that the first pawl 214A and the second pawl 214B interact respectively with the first teeth portion 202H and the second teeth portion 202I of the ratchet member 202. While in this engaged state, the safety latch system 200 enables the scissor lift assembly to (i) ascend and raise the platform 110 (ii) maintain a height of the platform 110, and (iii) provide a safety catch that stops a descent of the platform 110.

In contrast, when the lever 230 is activated, as shown in FIG. 7B, the lever 230 is configured to pull the pawl member 214 via the cable 232 such that the pawl member 214 disengages from the ratchet member 202. More specifically, as shown in FIG. 7B, for instance, the pawl member 214 is configured to rotate such that its first edge 214G and its second edge 214H become parallel or substantially parallel to the base line 40 of the first teeth portion 202H and the second teeth portion 202I, respectively. When the pawl member 214 is rotated forward and into this position via the pull of the cable 232 on the bar 214E, then the tip of the first pawl 214A and the tip of the second pawl 214B are pulled out of the depressions between respective sets of adjacent teeth. This rotation of the pawl member 214 about the rod 222 creates a space between that the first pawl 214A and the first teeth portion 202H and a space between the second pawl 214B and the second teeth portion 202I, thereby disengaging the safety latch system 200 and enabling the lift apparatus 100 to move freely. While in this disengaged state, the safety latch system 200 enables the scissor lift assembly to (i) ascend and raise the platform 110 and (ii) descend and lower the platform 110.

As discussed herein, the safety latch system 200 includes a number of advantageous features, as well as benefits. For example, the safety latch system 200 is configured to provide a safety catch mechanism to prevent a continued descent of the lift apparatus 100. The safety latch system 200 is connected to the actuator 140 to stop a continued descent of the support assembly 120 (e.g., scissor lift assembly) in the event that the actuator 140 fails or the piston rod 144 retracts unexpectedly. Advantageously, the safety latch system 200 is modular and configured to be retrofitted to various scissor lift systems or other suitable lift systems.

That is, the above description is intended to be illustrative, and not restrictive, and provided in the context of a particular application and its requirements. Those skilled in the art can appreciate from the foregoing description that the present invention may be implemented in a variety of forms, and that the various embodiments may be implemented alone or in combination. Therefore, while the embodiments of the present invention have been described in connection with particular examples thereof, the general principles defined herein may be applied to other embodiments and applications without departing from the spirit and scope of the described embodiments, and the true scope of the embodiments and/or methods of the present invention are not limited to the embodiments shown and described, since various modifications will become apparent to the skilled practitioner upon a study of the drawings, specification, and following claims. For example, components and functionality may be separated or combined differently than in the manner of the various described embodiments, and may be described using different terminology. These and other variations, modifications, additions, and improvements may fall within the scope of the disclosure as defined in the claims that follow.

What is claimed is:

1. A safety latch system comprising:

a mount mountable on a housing of a piston;

a pawl member coupled to the mount, the pawl member having a pawl;

a ratchet member having a first sidewall that includes a first connecting portion that is connectable to an end portion of a piston rod of the piston and a teeth portion that is configured to engage with the pawl; and a release assembly operably connected to the pawl member and configured to provide an engaged state between the pawl member and the ratchet member and a disengaged state between the pawl member and the ratchet member, wherein, when in the engaged state, the pawl member is engaged with the ratchet member such that the safety latch system is configured to provide (i) an unlocked state in which the ratchet member is movable relative to the pawl member as the piston rod advances outward from the housing and (ii) a locked state in which the pawl member is configured to lock into a depression between a set of adjacent teeth of the ratchet member to stop the piston rod from moving towards the housing; and when in the disengaged state, the pawl member is disengaged from the ratchet member to permit the piston rod to advance outward from the housing and permit the piston rod to retract towards the housing.

2. The safety latch system of claim 1, wherein:

the ratchet member includes a structural channel that is defined by the first sidewall and a second sidewall that are connected by a central wall; and the ratchet member is configured to receive the mount between the first sidewall and the second sidewall.

3. The safety latch system of claim 2, wherein:

the pawl member includes another pawl;

the second sidewall includes another teeth portion that is configured to interact with the another pawl; and the release assembly is configured to urge the another pawl out of another depression between another set of adjacent teeth in the another teeth portion at a same time that the release assembly urges the pawl out of the depression.

4. The safety latch system of claim 1, further comprising:

a spring connected to the pawl member and the mount, wherein the spring is configured to bias the pawl into the depression between the set of adjacent teeth to provide the locked state when the ratchet member begins to move with the piston towards the housing.

5. The safety latch system of claim 1, further comprising:

a guide member coupled to the mount, the guide member being configured to (a) guide a movement of the ratchet member with respect to the mount and (b) support an alignment of the ratchet member with respect to the piston rod, wherein the ratchet member is disposed between the guide member and the mount.

6. The safety latch system of claim 1, wherein the release assembly comprises:

a cable connected to the pawl member; and a lever operably connected to the pawl member via the cable such that activation of the lever urges the cable to move the pawl member such that the pawl is moved out of the depression between the set of adjacent teeth in the teeth portion.

7. The safety latch system of claim 1, wherein:

the teeth portion includes a plurality of teeth, each tooth has a first inclined surface and a second inclined surface, the second inclined surface being steeper than the first inclined surface;

when the ratchet member moves with the piston rod as the piston rod advances outward from the housing, the pawl engages with the first inclined surface from a peak of a first tooth towards the depression; and when the ratchet member begins to move with the piston rod as the piston rod moves towards the housing, the pawl stops the ratchet member from moving by abutting against the first inclined surface of the first tooth.

* * * * *